US012291857B2

(12) United States Patent
Hennessy et al.

(10) Patent No.: US 12,291,857 B2
(45) Date of Patent: May 6, 2025

(54) WATER-SAVING SIPHONIC TOILET AND EQUALIZATION SYSTEM THEREFOR

(71) Applicant: P & C Hennessy Holdings Inc., Frankford (CA)

(72) Inventors: Philip Hennessy, Frankford (CA); Jerrad Hennessy, Guelph (CA)

(73) Assignee: P & C Hennessy Holdings Inc., Frankford (CA)

( * ) Notice: Subject to any disclaimer, the term of this patent is extended or adjusted under 35 U.S.C. 154(b) by 214 days.

(21) Appl. No.: 17/098,051

(22) Filed: Nov. 13, 2020

(65) Prior Publication Data

US 2021/0140162 A1 May 13, 2021

Related U.S. Application Data

(60) Provisional application No. 62/934,729, filed on Nov. 13, 2019.

(51) Int. Cl.
*E03D 9/16* (2006.01)
*E03D 1/30* (2006.01)

(52) U.S. Cl.
CPC ..... *E03D 9/16* (2013.01); *E03D 1/306* (2013.01); *E03D 2201/30* (2013.01); *E03D 2201/40* (2013.01)

(58) Field of Classification Search
CPC .... E03D 5/01; E03D 3/10; E03D 9/16; E03D 1/306
USPC ..... 4/361, 362
See application file for complete search history.

(56) References Cited

U.S. PATENT DOCUMENTS 255,485 A * 3/1882 Boyle ..... E03D 5/00 4/328
530,306 A * 12/1894 Harvey ..... E03D 5/00 4/328
5,142,712 A * 9/1992 Hennessy ..... E03D 11/00 4/328
7,159,251 B2 * 1/2007 Hennessy ..... E03D 1/22 4/324
8,141,179 B2 * 3/2012 Hennessy ..... E03D 1/142 4/328

(Continued)

FOREIGN PATENT DOCUMENTS

CN 11034482 * 10/2019 ..... E03D 9/16

*Primary Examiner* — David P Angwin
*Assistant Examiner* — Nicholas A Ros
(74) *Attorney, Agent, or Firm* — Miller Thomson LLP

(57) ABSTRACT

A timed pressure equalization member for use in a siphonic toilet to reduce water loss at the end of a flush cycle is disclosed. The equalization member functions to equalize the pressure in a pressurized chamber after a set period of time and consequently alleviates negative pressure within a pressurized trapway system at or near the end of a flushing cycle via a conduit, to help break the siphon at the end of the flush cycle, thereby reducing the amount of water drained from the water bowl/spot while the bowl is being refilled. At a resting state, the equalization member in the pressurized chamber is partially filled with water. The equalization member empties of water after a set period of time during a flush cycle and allows atmospheric air to enter the pressurized chamber (in fluid communication with the pressurized trapway) at or near the end of the flush cycle.

19 Claims, 7 Drawing Sheets

(56) References Cited

U.S. PATENT DOCUMENTS

2005/0283895 A1* 12/2005 Tilson ..... E03D 1/34
4/378
2017/0314246 A1* 11/2017 Wagner ..... E03D 11/02

* cited by examiner

WATER-SAVING SIPHONIC TOILET AND EQUALIZATION SYSTEM THEREFOR

TECHNICAL FIELD

The present invention relates to plumbing products, and in particular to water saving toilets and components therefor.

BACKGROUND

Generally, modern flush toilets come in two varieties: washdown and siphonic. In a wash down toilet, the force of incoming water from the tank pushes waste through the water seal in the bowl and into the waste pipe. The waste pipe does not form a siphon. Instead, the waste pipe merely directs incoming waste and water into the sewer, often using a simple L-shaped configuration. In North America, the most commonly used style of toilet is siphonic fixtures.

In a siphonic toilet, the waste pipe is a trapway through which water is drawn over an intermediate elevation (weir). When the toilet is flushed, a siphon is formed in the trapway that actively pulls/vacuums waste from the bowl. At the end of the flushing action, air enters the trapway and breaks the siphon. Any remaining water that has passed the weir continues to flow to the drain and the only water remaining in the fixture is that which sits below the weir to provide the water spot and necessary sewer gas trap in the bowl. No water remains in a typical siphonic trapway below the weir after the flush is completed.

A need in the art remains to further improve siphonic toilet performance, and in particular, to reduce water consumption wherever possible, including flush volumes. There is also a need in the art for a toilet which improves on the above-noted deficiencies without sacrificing flush performance.

This background information is provided for the purpose of making known information believed by the applicant to be of possible relevance to the present invention. No admission is necessarily intended, nor should be construed, that any of the preceding information constitutes prior art against the present invention.

SUMMARY OF PARTICULAR EMBODIMENTS

It will be appreciated by those skilled in the art that other variations of the embodiments described below may also be practiced without departing from the scope of the invention. Further note, these embodiments, and other embodiments of the present invention will become more fully apparent from a review of the description and claims which follow.

In one embodiment, the present invention provides a pressurized siphonic trapway toilet with a timed pressure equalization system, to reduce water loss at the end of the flush cycle. This system functions to equalize the pressure in the pressure chamber after a set period of time, to help break the siphon at the end of the flush, thereby reducing the amount of water drained from the water seal/spot while the bowl is being refilled. In one embodiment, the timed equalization system is an equalization member in the pressure chamber that is partially filled with water. In this embodiment, the equalization member empties during the flush cycle and allows atmospheric air to enter a pressure chamber (in fluid communication with the toilet tank) at or near the end of the flush cycle. Other configurations are also contemplated.

In another aspect of the present disclosure, there is provided an equalization member for a toilet having a pressurized trapway. In this embodiment, the equalization member includes: a body portion for holding a volume of water in a pressure chamber of the toilet; a second end (or outlet) of the body portion positioned above a flush level in the pressure chamber, the second end having an opening for draining the body portion during the flush cycle; a first end (or inlet) of the body portion positioned above the tank full level in the pressure chamber, the first end being open to atmospheric air; wherein the body portion and second end are sized to permit a volume of water to drain from the body portion within a pre-determined time period. In one embodiment, the second end is sized as to allow the water to drain from the equalization member within approximately two (2) to three (3) seconds, which is similar to the time required to complete the flush and remove waste from the pan of the bowl in a low-flush toilet configuration.

In another embodiment, there is provided an equalization member for a siphonic flush toilet that includes a toilet bowl, a pressurized trapway for carrying the contents of the bowl to a drain during flushing, a tank, and a water supply in the tank that flows water into the bowl on each flushing, the trapway including upper and lower traps, and wherein a source of pressurized air in the tank is coupled to the trapway to establish a positive air pressure, that is above atmospheric pressure, in the trapway prior to flushing, and wherein the lower trap remains closed prior to flushing to maintain positive air pressure between the upper and lower traps prior to flushing, the equalization member comprising a body portion for holding a volume of fluid, a first end of the body portion, and a second end of the boy portion, wherein the equalization member is coupled to the source of pressurized air and the trapway.

In some embodiments described herein, the pre-determined time period corresponds to the end of the flushing action and/or the second end has a restricted opening so as to retain water in the body portion for the pre-determined time period.

In another broad aspect of the present disclosure, there is provided a method of flushing a toilet with a pressurized trapway. The method includes the steps of: generating a negative pressure in a head space of the trapway to induce the formation of a siphon in the trapway; maintaining said negative pressure during the flushing action; at the end of the flushing action, equalizing the negative pressure in the headspace of the trapway, so as to break the siphon and allow all three (3) areas: trapway upleg, downleg and pressure chamber inside the toilet tank to return to a resting state after flushing.

In some embodiments, the negative pressure is generated in a pressure chamber, as shown and described herein, and the step of equalizing comprises opening a passage between the pressure chamber and the atmosphere. The method may also include the further step of, prior to flushing the toilet, generating a positive pressure in the head space of the trapway, to increase the size of the water spot. In some cases, the equalization step is performed by an equalization member, as shown and described herein.

In another broad aspect of the present disclosure, there is provided a tank or cistern comprising: an atmosphere chamber for holding a first volume of water; a pressure chamber for holding a further volume of water and an enclosed air volume; an outlet in communication with the atmosphere chamber and the pressure chamber; a water supply for providing water to the tank full level; a flush valve for selectively releasing water from the outlet to a bowl; a pressure conduit in communication with the pressure chamber, for transmitting a positive or negative pressure from the enclosed air volume as the second volume of water raises or lowers in the pressure chamber; and an equalization member of the type shown and described herein.

BRIEF DESCRIPTION OF THE DRAWINGS

In the drawings, preferred embodiments of the invention are illustrated by way of example. It is to be expressly understood that the drawings are only for the purpose of illustration and as an aid to understanding and are not intended as a definition of the limits of the invention. The embodiments herein will be understood from the following description with reference to the drawings, in which.

DETAILED DESCRIPTION OF EXAMPLE EMBODIMENTS

Figure 1:
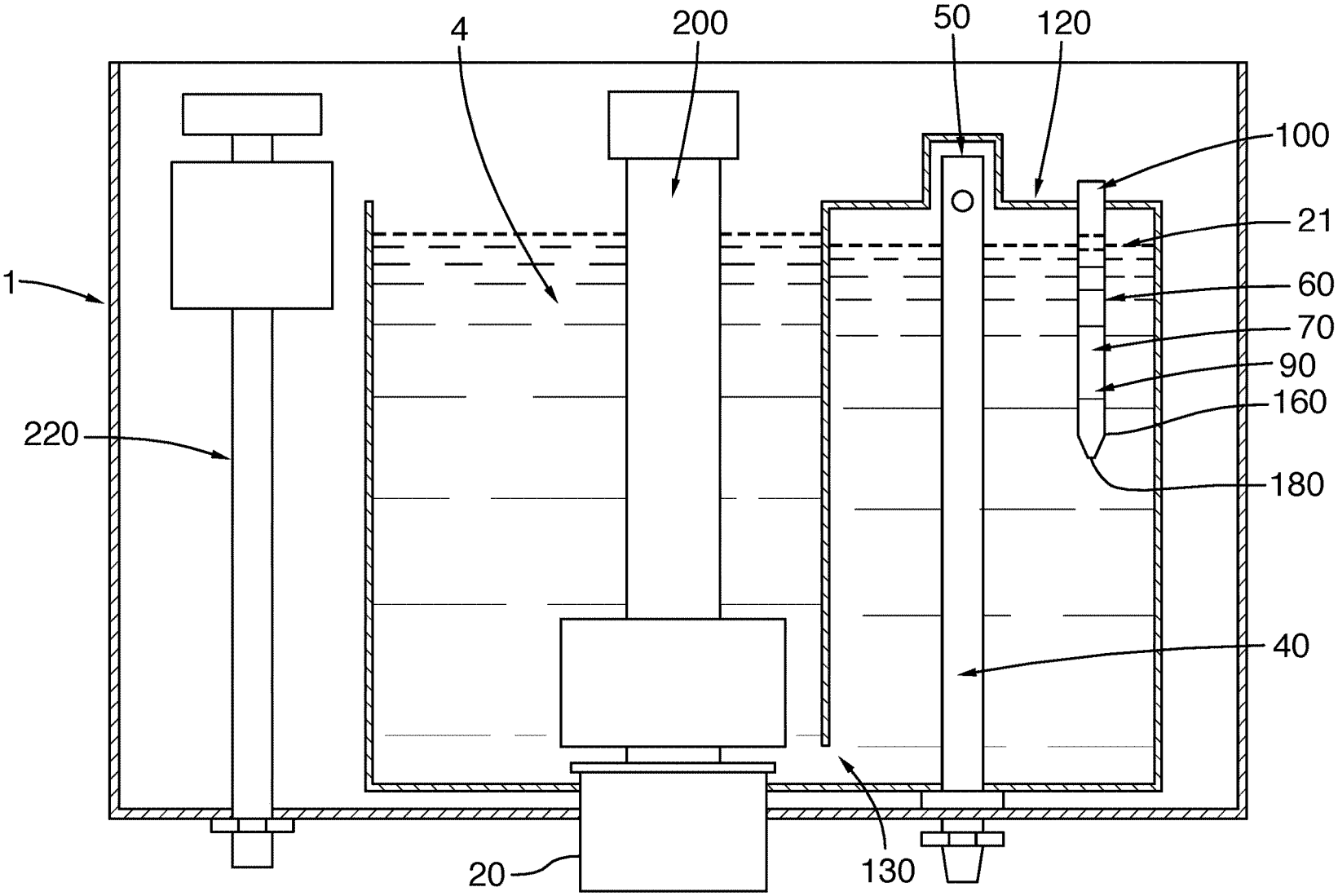
FIG. 1 provides a cross-sectional front elevation view of a toilet tank which incorporates a timed equalization system, at a resting state, according to an embodiment of the present disclosure.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. In particular, all terms used herein are used in accordance with their ordinary meanings unless the context or definition clearly indicates otherwise. Also, unless indicated otherwise except within the claims the use of "or" includes "and" and vice-versa. Non-limiting terms are not to be construed as limiting unless expressly stated or the context clearly indicates otherwise (for example, "including", "having", "characterized by" and "comprising" typically indicate "including without limitation"). Singular forms included in the claims such as "a", "an" and "the" include the plural reference unless expressly stated or the context clearly indicates otherwise. Further, the stated features and/or configurations or embodiments thereof the suggested intent may be applied as seen fit to certain operating conditions or environments by one experienced in the field of art. As used herein, the term "substantially" is used in accordance with its plain and/or ordinary definition, and means "complete to a large degree" or "to a near-complete extent". For example, "substantially complete" means that an action, feature, characteristic, state, structure, item, or result is "complete to a large extent". As used herein, and unless otherwise stated, the terms "about" and "approximately" are used in accordance with their plain and/or ordinary definitions, and mean an acceptable error for a particular value as determined by those of ordinary skill in the art, which depends in part on how to measure or determine the value. As used herein, references to the term toilet includes, but is not limited to both two-piece toilet designs, where the toilet tank and bowl are configured as separate components to be connected together, and one-piece toilet designs, where the toilet tank and bowl are fused together without any joints.

In one embodiment, the present invention is a water-saving toilet utilizing a pressurized siphonic trapway, wherein during the flush cycle, a partial vacuum is created in a head space of the trapway, which assists the formation of a siphon at the start of the flush cycle. Such pressurized system allows for reduced water consumption, increased flushing power, and larger water spots. In one embodiment, the toilet has a fixed cavity of water held within the toilet bowl, which flows into the pan of the bowl after the flush to replenish the water spot.

In one embodiment, the present invention utilizes a pressurized trapway flushing system, wherein the negative pressure created at the onset of the flush cycle must later be transformed into a positive pressure to allow water to replenish water held in the pan of the bowl to recreate and maintain at resting state the water spot, which is required by most plumbing codes to be a minimum of a ~50 mm seal.

For the water spot to be replenished, the negative pressure subsides when the water in the flushing chamber (which is open to the atmosphere) reaches a higher elevation than the water in the enclosed pressure chamber of toilet tank.

In one embodiment of the present invention, when air enters the trapway of the pressurized system through the well of the bowl at the end of the flush cycle, negative pressure continues to be applied until a point where the water levels in the atmosphere and pressure chamber of the toilet tank trim equalize and thus allow enough air from the atmosphere to re-enter the trapway to alleviate the negative pressure, thus letting the water being held up by the negative pressure to fall and stop the siphon action inside the trapway. The degree to which the water levels differ impacts the length of time the negative pressure is applied and can result in less water being available to refill the water spot in the bowl. There are three (3) areas of the toilet that maintain a consistent and equal differential in water levels from areas open to the atmosphere: the trapway upleg, downleg and pressure chamber of the toilet tank trim. These water level differentials are equivalent to the pressure being applied on the trapway and flushing system.

The water level in the atmosphere side can only refill at the same rate refill that the holes in the trim allow, which are dependent on the rate the fill valve replenishes water in the tank. Therefore, in areas with low water pressure (e.g. less than 30 PSI) the tank will take longer to refill, resulting in the negative pressure being applied for a longer period of time on the system and less water being available to refill the water spot in the bowl.

Styles of toilets purchased have changed over the years with many consumers now looking to buy more compact and sleekly designed thinner cisterns (or tanks). The distance in water levels after a flush cycle between the atmosphere and pressure chamber increases as the tank becomes narrower or more compact because the toilet tank trim itself must become narrower and taller to still hold the same volume of water and air.

The same phenomenon occurs whereby water level distance increases if the flush volume is increased to meet needs of commercial applications where subsequent water flow is required. In these applications the entire tank could be displaced during the flush creating, for example, ~50 mm of difference in water levels between the atmosphere and pressure chamber. This negative pressure being applied due to the water level difference continues to apply the same amount of pressure on the trapway, thus pulling water that is intended to be used to restore the water spot at the resting state from the bowl and over the weir. In one aspect thereof, the present invention comprises an equalization system that allows the toilet tank and trapway of the pressurized trapway toilet to equalize more quickly and stop the siphon action after a flush is complete. The inventions described herein can be used with a range of toilets and toilet designs, including both narrower compact cisterns, and low water pressure or higher flush volumes for commercial applications.

In one embodiment, as depicted in the drawings, the present invention provides a pressurized siphonic trapway toilet with a timed pressure equalization system to reduce water losses at the end of the flush cycle, wherein the system is designed for use with a toilet (not shown) comprising a cistern or tank 1 having an outlet 20 that supplies water to a (pan or) bowl 3. Waste water from the bowl 3 is directed to a trapway 2 that transmits the waste water to a sewer system. In one aspect of the present invention, a timed system to equalize the pressure in the trapway 2 at the end of the flushing action is described.

The embodiments shown in FIGS. 1 to 6 include reference to an equalization member 60 that functions to equalize the pressure in a pressure chamber 120 and a trapway 2 during or after a flushing action. In one embodiment, the equalization member 60 functions to equalize the pressure after a pre-determined period of time has lapsed, which correlates with the duration of the flushing action.

In the embodiment shown in FIG. 1, the equalization member 60 consists of a first end 100 and a second end 180 and a body portion 70 there-between, wherein the body portion 70 defines a channel 90 connecting the first end 100 and the second end 180. In one embodiment, the body portion 70 defines a channel 90 that is uniform across its entire length in the longitudinal direction. At each of the first end 100 and the second end 180 are apertures (or openings) that allow fluid and air to pass through the channel 90 within the equalization member body portion 70. In one embodiment, the body portion 70 of the equalization member 60 has a generally cylindrical shape. In another embodiment, the equalization member 60 is uniformly shaped between the first end 100 and the second end 180. In a preferred embodiment, the body portion 70 is tapered toward the second end 180 of the equalization member 60, such that the cross-sectional diameter of the body portion 70 may narrow beginning at a determined point 160 towards the second end 180, such that the cross-sectional diameter of the opening of the second end 180 is smaller than the cross-sectional diameter of the opening at the first end 100, and wherein the cross-sectional diameter of the body portion 70 begins to taper at the determined point 160. In the embodiment shown in FIG. 1, the body portion 70 has uniform dimensions across its length until the determined point 160. In one embodiment, the cross-sectional diameter of the opening of the second end 180 is sized to allow water to drain from the equalization member 60 in a desired draining time. In one embodiment, the opening of the first end 100 and/or the second end 180 can be round, square or other shapes. In another embodiment, the outer surface of the second end 180 is tapered relative to the body portion 70, and a continuous inner flange (not shown) extends upwardly from the opening of the second end 180 to create an elevated interior surface within the second end 180 to prevent water droplets from blocking air flow into the pressure chamber 120.

In the embodiment shown in FIG. 1, the equalization member 60 may be disposed within an upper wall of the pressure chamber 120, such that the first end 100 of the equalization member 60 is open to the tank, and the body portion 70 of the equalization member 60 extends into the pressure chamber 120. The equalization member 60 and pressure chamber 120 may be formed in a unitary construction. Alternatively, the equalization member 60 can be provided as a stand-alone component which is configured to interoperate with the pressure chamber 120.

Figure 2:
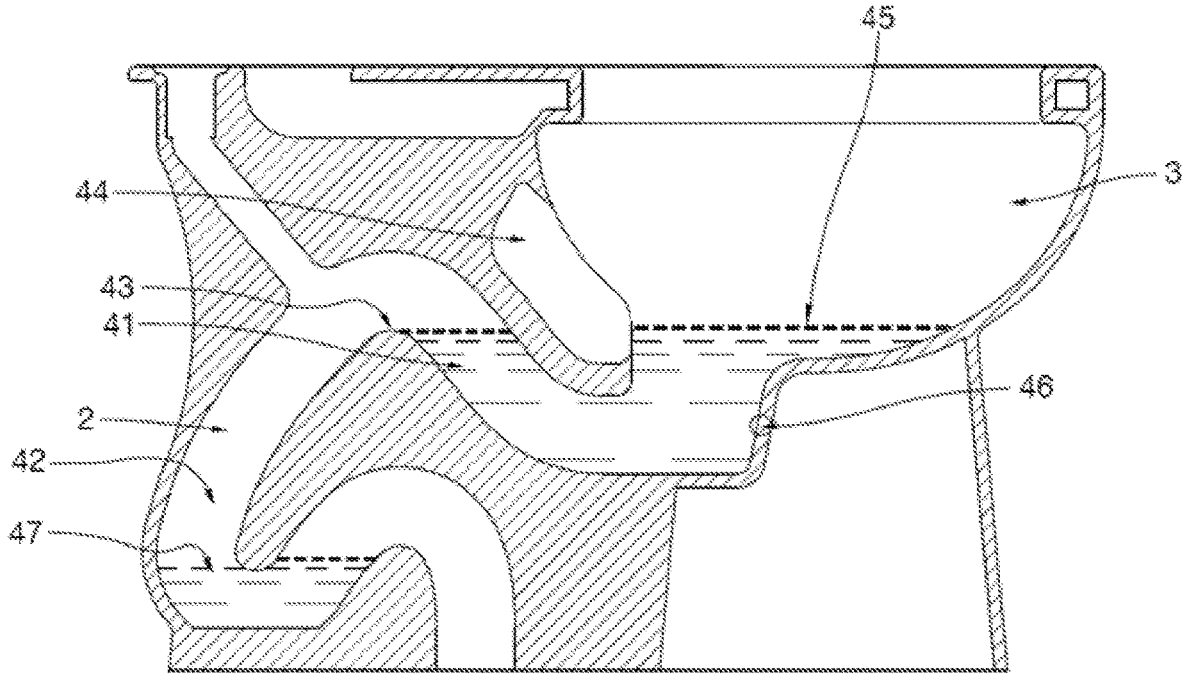
FIG. 2 provides a cross-sectional side elevation view of a pressurized trapway contained in a toilet bowl, at a resting state, according to an embodiment of the present disclosure.

FIG. 1 and FIG. 2 illustrate the pressure chamber 120 and the trapway 2 of the toilet at a resting state, in accordance with one embodiment of the present invention. In this state, the second end 180 of the equalization member 60 extends below the resting water level 21 of the pressure chamber 120 and the first end 100 is above the resting water level 21 and open to the atmosphere. In the resting state, the equalization member 60 is partly filled as the tank has been refilled with water supplied by a water source (not shown) connected to the toilet (for example, via a water source-toilet connection via conventional plumbing means, such as a water supply valve 220 connecting a water source to the toilet, usually at the base of the tank). In the resting state, the resting water level 21 remains below the first end 100 of the equalization member 60 and the inlet 50 of the pressure conduit 40.

In the embodiments shown, at resting state, the pressure chamber 120 is sealed to the atmosphere. Similarly, at resting state, the trapway 2 is sealed to the atmosphere due to water resting in the trapway upleg 41 and water resting in the trapway downleg 42 that creates a water seal 47 to the sewer system to prevent gases or other materials from moving from the sewer system into the trapway 2 or pressure chamber 120. At this resting state, the pressure chamber 120, trapway upleg 41 and downleg 42 are at the same pressure.

Figure 3:
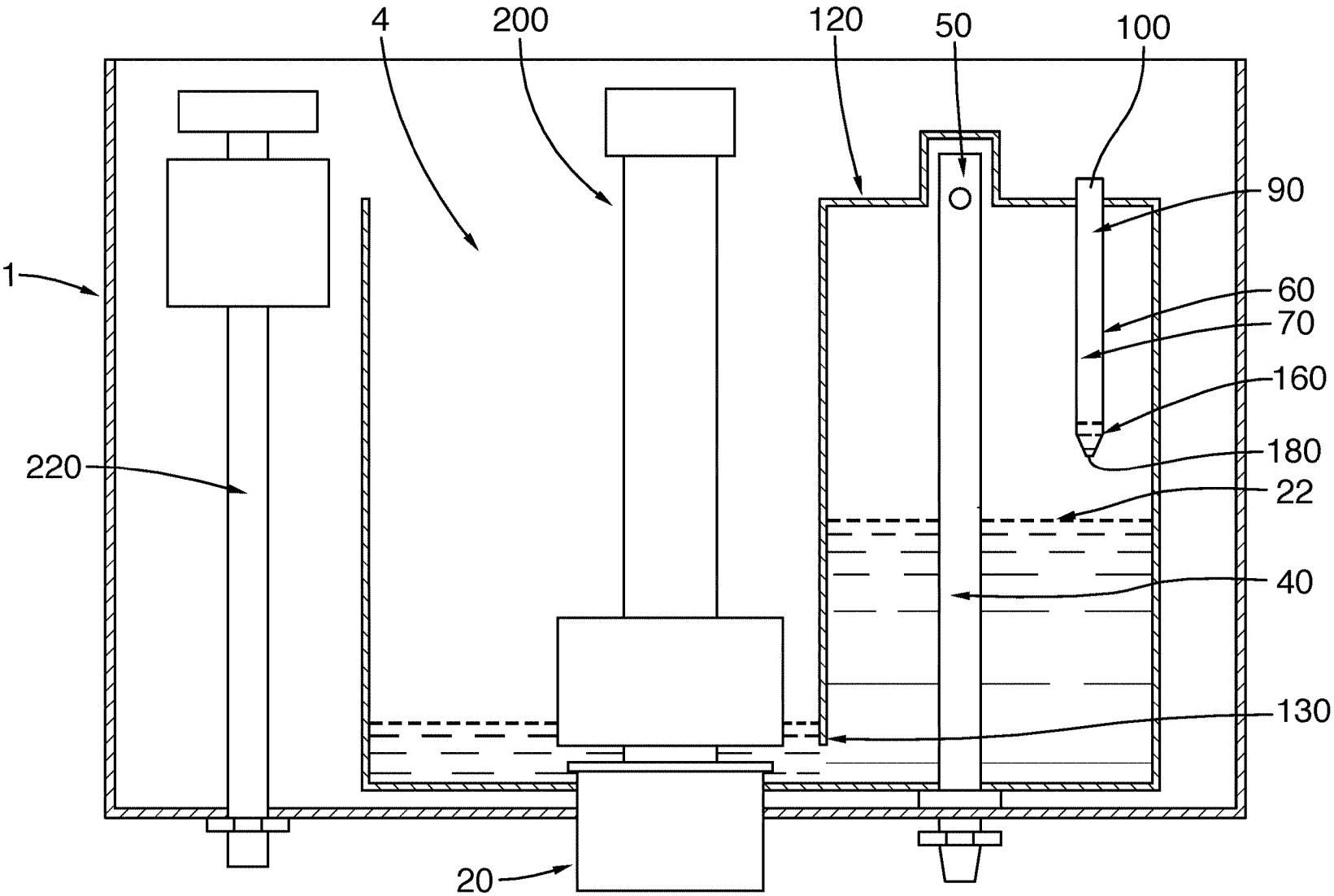
FIG. 3 provides a cross-sectional front elevation view of the tank of FIG. 1 during a flushing action while negative pressure is still being applied to the trapway, according to an embodiment of the present disclosure.
Figure 4:
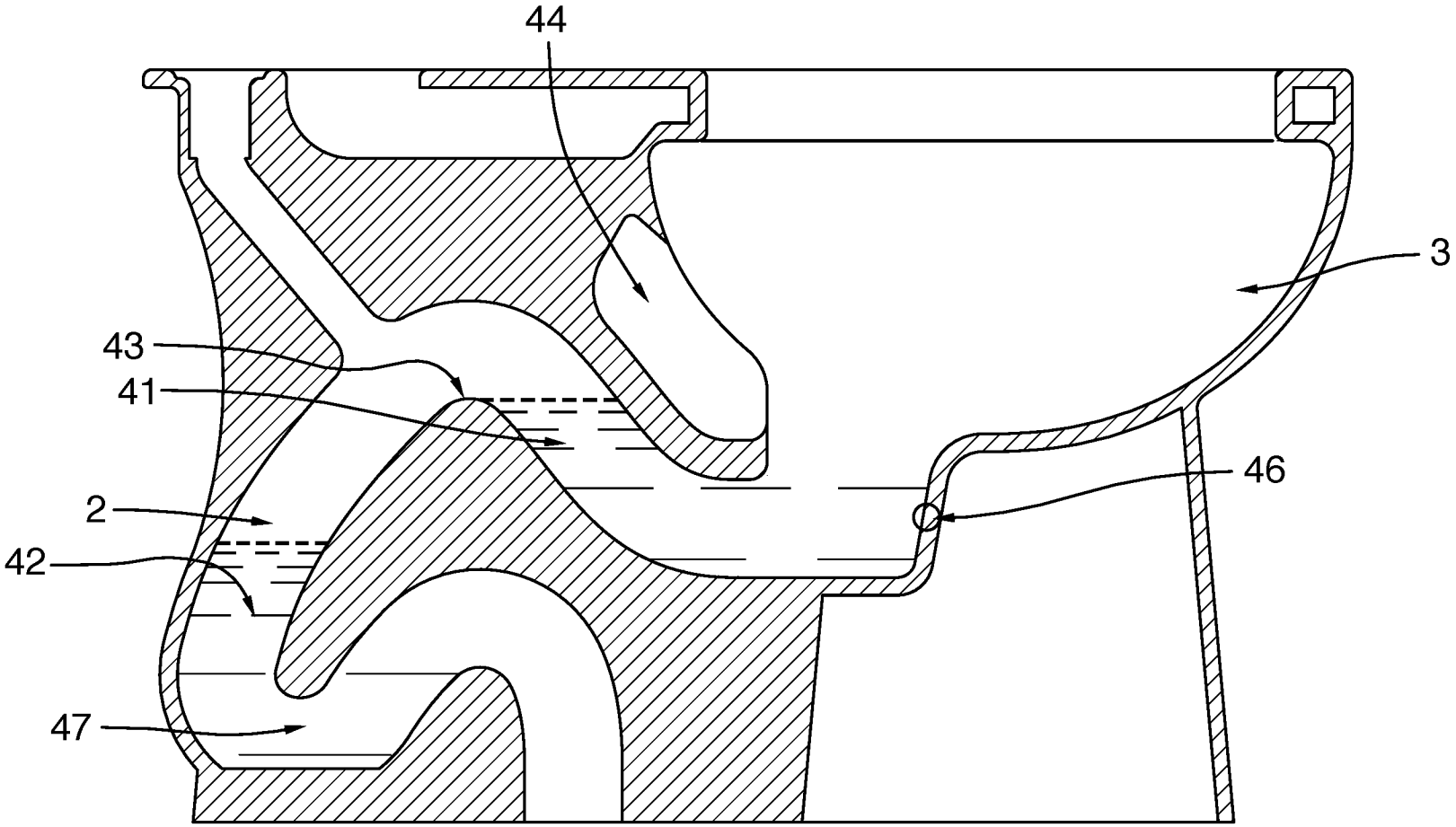
FIG. 4 provides a cross-sectional side elevation view of the pressurized trapway of FIG. 2, during a flushing action while negative pressure is still being applied to the trapway, according to an embodiment of the present disclosure.

FIG. 3 and FIG. 4 show the pressure chamber 120 and trapway 2 during flushing action, in accordance with one embodiment of the present invention. The flushing action is initialized by the flush valve 200 opening, causing water to drain from the atmosphere chamber 4 and pressure chamber 120 through an outlet 20 towards the bowl 3. As the water level within the pressure chamber 120 lowers, the pressure of the enclosed air in the pressure chamber 120 drops and this negative pressure is exerted on the trapway 2 through the pressure conduit 40. This negative pressure exerted on the headspace of the trapway 2 and the water in the trapway upleg 41 induces the formation of a siphon in the trapway 2 and causes water in the pan or bowl 3 to drain through the trapway downleg 42 towards a sewer system. The negative pressure in the trapway 2 also acts on the water in the trapway downleg 42, but does not break the water seal 47 before the siphon is created. When the water level in the pressure chamber 120 is lower than the second end 180 of the equalization member 60, the water begins to drain from the second end 180. In this embodiment, the tapered second end 180 of the equalization member 60 restricts the flow of water, which slows the rate at which the equalization member 60 drains, thereby lengthening the time required before equalization occurs.

During a flushing action, the flush valve 200 closes before the level of water drained from the atmosphere chamber 4 and pressure chamber 120 is lower than the bottom of the pressure chamber wall 130 to maintain this seal of the pressure chamber 120 to the atmosphere. The only air that enters the pressure chamber 120 or trapway 2 is atmospheric air from either a drained equalization member 60 or through the trapway upleg 41 from the atmosphere exposed pan or bowl 3 during a flushing action.

Figure 5:
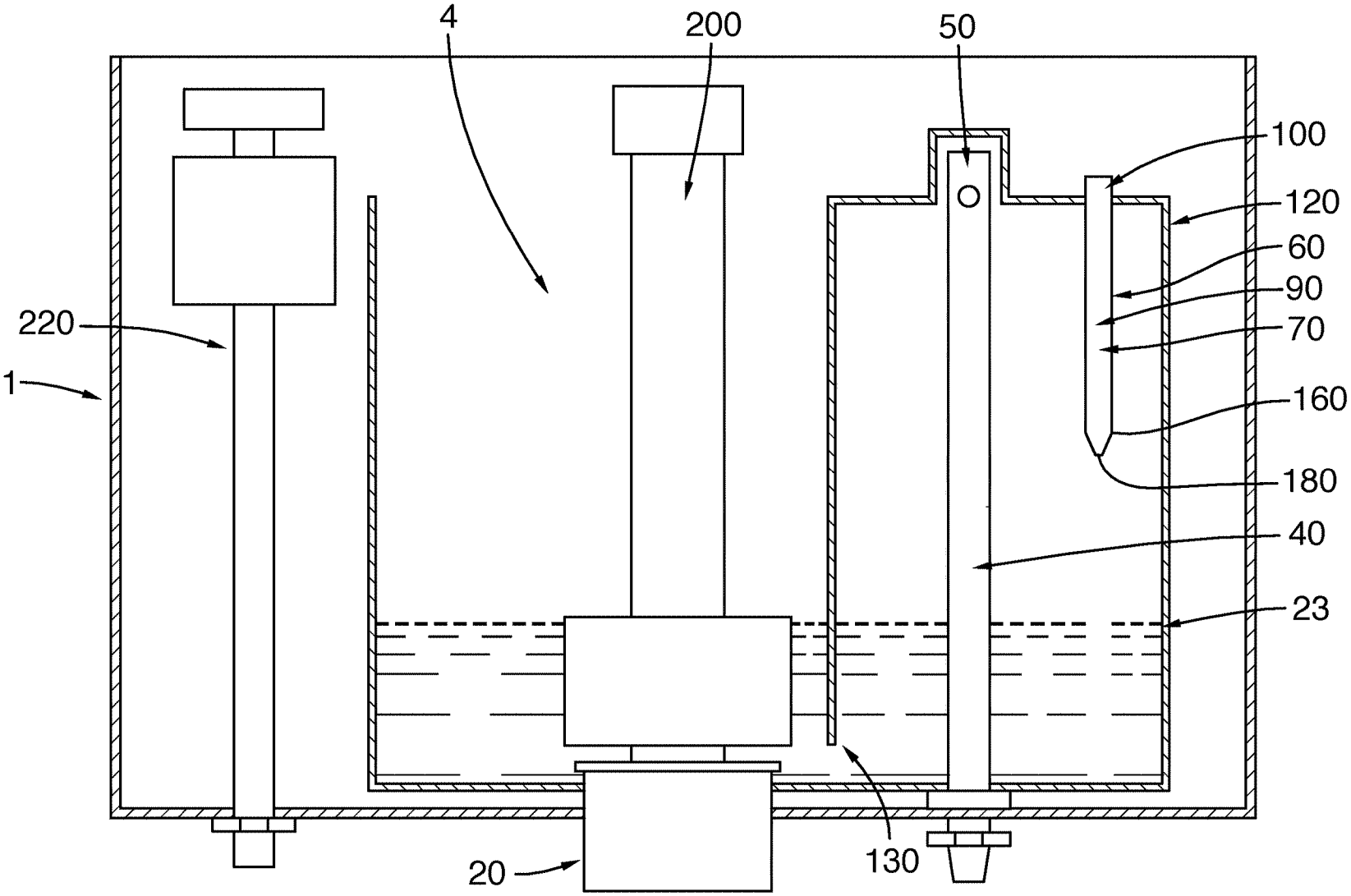
FIG. 5 provides a cross-sectional front elevation view of the tank of FIG. 1 at or near the end of a flushing action wherein equalization is either complete or is substantially complete, according to an embodiment of the present disclosure.
Figure 6:
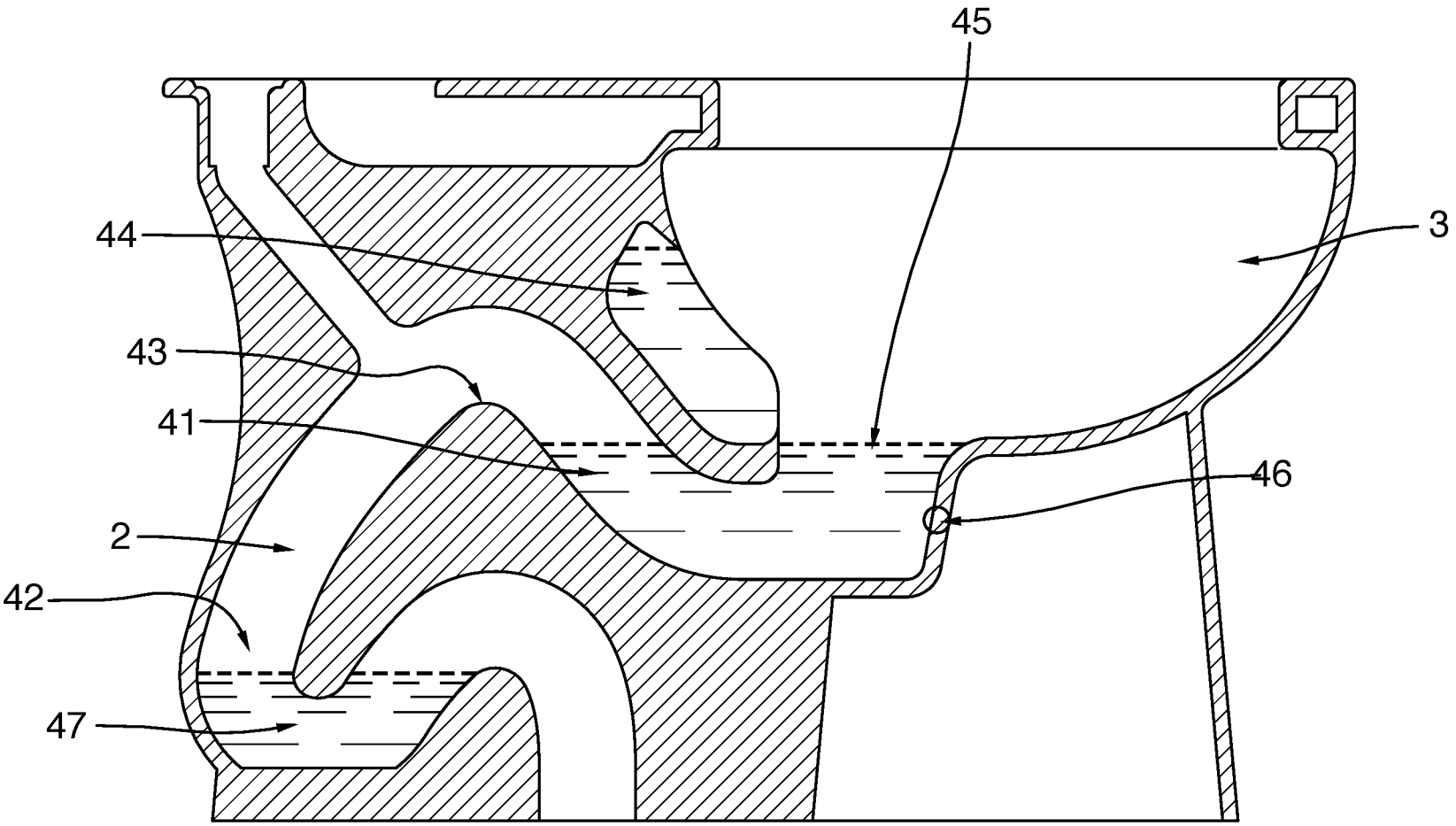
FIG. 6 provides a cross-sectional side elevation view of the pressurized trapway of FIG. 2 at or near the end of a flushing action wherein equalization is either complete or is substantially complete.
Figure 7:
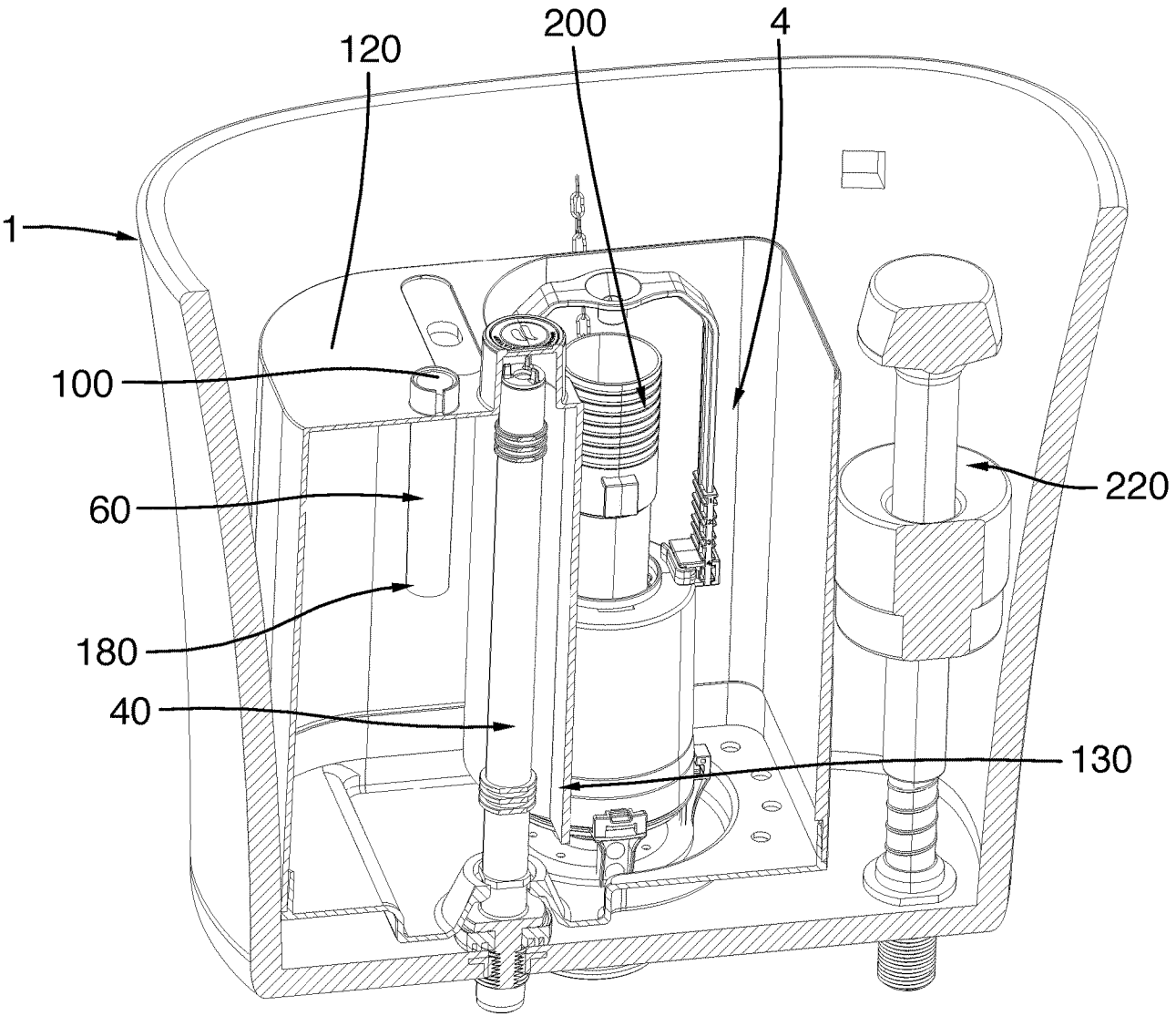
FIG. 7 provides a partial cross-sectional perspective view of a toilet tank in accordance with one embodiment of the present disclosure.

FIG. 5 and FIG. 6 show the pressure chamber 120 and trapway 2 shortly after a predetermined time, which optionally occurs at the end or substantially at the end of the flushing action, or shortly after the end of the flushing action, in accordance with one embodiment of the present invention. Here, the water within the equalization member 60 has drained through the second end 180, allowing air from the first end 100 to enter the pressure chamber 120. The atmospheric air flowing through the equalization member 60 raises the pressure of the air inside the pressure chamber 120 and consequently raises the pressure of the air in the pressure conduit 40, which in turn acts on the headspace of the trapway 2 to break the siphon at or near the end of the flush and stops the flow of water from the pan or bowl 3 into the sewer system. The resulting action is that the water levels in the pressure chamber 120 and atmosphere chamber 4 equalize at level 23. In one embodiment, when the equalization member 60 empties and allows air to enter and break the siphon in the trapway 2 it is the true end of the flushing action since from that point forward the bowl 3 begins to regenerate and the system moves towards to the resting state.

At the end of the flushing action, water is pumped into the cistern or tank 1 from a water supply valve 220 or equivalent. As the water level in the pressure chamber raises above the second end 180 of the equalization member 60, the enclosed air in the pressure chamber 120 begins to be compressed, exerting positive pressure on the pressure conduit 40 and the trapway 2. At resting state, there is positive pressure in the pressure chamber 120, trapway upleg 41 and downleg 42. This positive pressure acts on the water resting in the trapway upleg 41, allowing for a larger water spot 45 to form in the bowl 3 over the weir 43.

If the pressurized trapway system operated without the described equalization system, being a timed pressure equalization system, the negative pressure imparted by the pressure conduit 40 on the headspace of the trapway 2 during a flushing action will continue past the end of the flushing action, resulting in residual water loss from the bowl 3 as it is being refilled through a hole 46 in the well of the bowl 3 from a fixed cavity 44 of water held within the bowl 3. The embodiments described herein include that the equalization system reduces residual water losses during the final moments of the flushing action, particularly when the bowl 3 is being refilled to re-establish a water spot 45.

The length of the equalization member 60 and/or the size of the pressure chamber 120 are sized such that at resting state the second end 180 is lower than the resting water level 21 and during a flushing action the flushing action water level 22 lowers below the second end 180 before the flushing action is complete to ensure that the equalization member 60 will fill up with and drain water in the pressure chamber 120. The length and cross-sectional area of the internal channel 90 in the equalization member 60 are sized according to the desired draining time of the equalization member 60, which shall be set in accordance with the specifications of the toilet in question. Similarly, the cross-sectional diameter of the opening at the second end 180 is sized according to the desired draining time of the equalization member 60.

In an embodiment, the first end 100 of the equalization member 60 has a covering (not shown) to minimize dirt or debris from entering the equalization member 60. In this embodiment, the covering has a narrow opening slit to allow air from the atmosphere to enter the equalization member 60. The outer or inner shape of the equalization member 60 can be varied. For example, in one embodiment, the equalization member 60 can be shaped conically. In another embodiment, the equalization member can have a prism, spherical, or parallelepiped shape. In addition, in one embodiment, the equalization member 60 can be located externally, or partially externally or substantially externally to the pressure chamber 120.

In an embodiment, the pressure chamber 120 is comprised of composite material and is built directly into the cistern or tank 1 and shares an outer wall and top cover with the tank 1.

In an embodiment, the equalization member 60 is a separate component of the pressure chamber 120 and is removable. In this embodiment, equalization members 60 of different specifications can be interchanged according to the specifications of the flushing action of the associated toilet system. In an embodiment, the separable equalization member 60 may be attached to the pressure chamber 120 by a removable or non-removable fastener or an adhesive. In one embodiment, the equalization member 60 is built directly into the top of the pressure chamber 120 and is not removable.

In an embodiment, the equalization member 60 shares a side wall with the pressure chamber 120. In another embodiment, the equalization member does not contact the side walls of the pressure chamber 120.

Numerous other configurations are also contemplated. For example, the equalization member 60 may take the form of a mechanical relief valve that is configured to open on a timer after the flush lever is activated or in response to a sustained negative pressure within the pressure chamber 120. In either case, the equalization of pressure within the pressure chamber 120 would achieve the same result. Such configurations are less preferred, however, as the use of complex mechanical arrangements increases the complexity of manufacture and the likelihood of failure. Moreover, it is preferable to reduce the number of internal components for the tank, due to space and cost limitations. Nevertheless, other equalization member configurations are contemplated by the inventors and are within the scope of the present invention.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any modification, combination or permutation of any of the components, elements, functions, operations, or steps described or illustrated anywhere herein that a person having ordinary skill in the art would comprehend. All such modifications, combinations and permutations are believed to be within the sphere and scope of the invention as defined by the claims appended hereto.

We claim:

1. An equalization member for a siphonic toilet having a pressurized trapway coupled with an area of pressurized air in a chamber of mixed air and water, wherein the equalization member is coupled with said pressurized trapway and chamber, the equalization member comprising:

a. a body portion for holding a volume of water;

b. a first end of the equalization member positioned above the water level in said chamber at resting state, said first end having an opening and being open to the atmosphere; and c. a second end of the equalization member positioned below the water level in said chamber at resting state, said second end having a restricted opening to permit the timed passage of water through the equalization member, wherein the body portion is a water reservoir and the second end has a restricted opening to permit a volume of water to completely drain from the body portion of the equalization member and permit air to enter the equalization member after a pre-determined time period during a flush, which in turn allows water levels inside and outside the chamber to reach the same elevation near or at the end of the flushing cycle to ensure a full seal regardless of water volume flushed.

2. A siphonic flush toilet including a toilet bowl, a pressurized trapway for carrying the contents of the bowl to a drain during flushing, a tank, a flush valve, and a water supply in the tank that flows water into the bowl on each flushing, the trapway including upper and lower traps, comprising a timed pressure equalization system, the system comprising:

a. A source of pressurized air in the tank and coupled to the trapway to establish a positive air pressure, above atmospheric pressure, in the trapway prior to flushing, wherein the lower trap remains closed prior to flushing to maintain positive air pressure between the upper and lower traps prior to flushing; and b. An equalization member having a first end and a second end, and a body portion there-between, the equalization member coupled to the source of pressurized air and the trapway, the equalization member having a reservoir for holding a defined quantity of water and a restricted opening at the second end, the restricted opening in fluid communication with the water reservoir, the equalization member for timing and regulating the transition from negative to positive pressure after the siphon breaks to reduce the loss of residual water used to refill the pan from a fixed cavity within the bowl, wherein the reservoir and restricted opening are sized to permit a volume of water to completely drain from the reservoir and permit air to enter the equalization member after a pre-determined time period during a flush.

3. The siphonic flush toilet of claim 2 wherein the body portion of the equalization member is sized to hold a precise quantity of water which drain out completely from the equalization member near or at the end of the flush.

4. The siphonic flush toilet of claim 2 wherein the body portion of the equalization member has a generally cylindrical shape.

5. The siphonic flush toilet of claim 2, wherein the body portion is a reservoir specifically sized to hold a volume of water sufficient to permit the equalization member to function as a timing device for delaying the passage of air through the equalization member until after the siphon has broken.

6. The siphonic flush toilet of claim 2 wherein the equalization member body portion defines a channel connecting the first end and the second end of the equalization member.

7. The siphonic flush toilet of claim 6 wherein the first end of the equalization member has an opening and the second end of the equalization member has an opening and each opening allows fluid to pass through the body portion of the equalization member.

8. The siphonic flush toilet of claim 7 wherein the body portion of the equalization member and the second end of the equalization member are sized to permit a volume of water held in the body portion of the equalization member at resting state to drain from the body portion within a pre-determined time period.

9. The siphonic flush toilet of claim 8 wherein the second end of the equalization member has a restricted opening so as to retain water in the body portion for the pre-determined period.

10. The siphonic flush toilet of claim 2 wherein the tank includes:

a. a first chamber that is vented to the atmosphere, said first chamber having a flush valve to release water at each flushing to flow to the toilet bowl and includes a water supply that refills the tank after each flushing; and b. a second chamber comprising an air trapping region that traps and pressurizes the air where the first chamber refills with water and water is present in the equalization member; and c. a conduit that connects the air trapping region of said second chamber to the trapway to pressurize the trapway prior to each flushing, wherein said first chamber and said second chamber are connected by a coupling region that is open to the bottoms of said first and second chambers such that water can pass between the first and second chambers.

11. The siphonic flush toilet of claim 10 wherein the equalization member is oriented such that the first end is located above the second end.

12. The siphonic flush toilet of claim 10 wherein the equalization member is coupled to an upper portion of the second chamber.

13. The siphonic flush toilet of claim 10 wherein at resting state:

a. the first end of the equalization member is positioned above the water level in the second chamber and exposed to atmospheric pressure; and b. the second end of the equalization member is positioned below the water level in the second chamber.

14. The siphonic flush toilet of claim 10 wherein at or near the end of a flush:

a. the first end of the equalization member is positioned above the water level in the second chamber and exposed to atmospheric pressure; and b. the second end of the equalization member is positioned above the water level in the second chamber.

15. The siphonic flush toilet of claim 10 wherein the equalization member is longitudinally sized such that:

a. at resting state the second end of the equalization member is lower than the water level in the second chamber; and b. when the system equalizes at or near the end of a flush the second end of the equalization member is above the water level in the second chamber.

16. The siphonic flush toilet of claim 10, wherein the equalization member is coupled to the source of pressurized air and the trapway, the equalization member for balancing the water levels in the first chamber and the second chamber after the siphon has broken to reduce the loss of residual water.

17. A method of flushing the siphonic flush toilet of claim 2, the method comprising:

a. generating a negative pressure in a head space of the trapway to induce the formation of a siphon in the trapway; and b. maintaining said negative pressure during the flushing action; and at the end of the flushing action, equalizing the negative pressure in the headspace of the trapway, so as to induce cessation of the siphon.

18. The method of claim 17, wherein the negative pressure is generated in a pressure chamber coupled to the atmosphere and the trapway, and the step of equalizing comprises opening a passage between the pressure chamber and the atmosphere.

19. The method of claim 18, further comprising, prior to flushing the toilet, generating a positive pressure in the head space of the trapway, to increase the size of the water spot in a bowl of the toilet.

* * * * *